US008635967B1

(12) United States Patent
Chang, III et al.

(10) Patent No.: US 8,635,967 B1
(45) Date of Patent: Jan. 28, 2014

(54) BALLAST STRUCTURE FOR REDUCING WATER-MIXING IN SHIPS

(75) Inventors: Peter A. Chang, III, Silver Spring, MD (US); Wesley M. Wilson, Ijamsville, MD (US)

(73) Assignee: The United States of America as represented by the Secretarey of the Navy, Washington, DC (US)

( * ) Notice: Subject to any disclaimer, the term of this patent is extended or adjusted under 35 U.S.C. 154(b) by 50 days.

(21) Appl. No.: 13/193,430

(22) Filed: Jul. 28, 2011

Related U.S. Application Data

(60) Provisional application No. 61/385,604, filed on Sep. 23, 2010.

(51) Int. Cl.
*B63B 39/03* (2006.01)

(52) U.S. Cl.
USPC ..... 114/125; 210/760

(58) Field of Classification Search
USPC ..... 114/125
See application file for complete search history.

(56) References Cited

U.S. PATENT DOCUMENTS 5,816,181 A 10/1998 Sherman, Jr.
6,076,480 A * 6/2000 Chang et al. ..... 114/125
6,613,232 B2 9/2003 Chesner et al.
7,005,074 B2 * 2/2006 Nguyen et al. ..... 210/748.11
7,240,631 B1 * 7/2007 Al-Babtain ..... 114/125
7,416,666 B2 * 8/2008 Gordon ..... 210/257.2
7,455,022 B2 * 11/2008 Randall ..... 114/125
7,595,003 B2 * 9/2009 Maddox ..... 210/748.03
7,833,411 B2 * 11/2010 Ueki et al. ..... 210/96.1
7,897,045 B2 * 3/2011 Nguyen ..... 210/205
7,921,790 B2 * 4/2011 Arai et al. ..... 114/125
8,025,795 B2 * 9/2011 Miner et al. ..... 210/97
8,038,875 B2 * 10/2011 Fukuyo et al. ..... 210/137
8,136,465 B2 * 3/2012 McCarthy et al. ..... 114/125
8,147,686 B2 * 4/2012 Ueki et al. ..... 210/96.1
8,147,687 B2 * 4/2012 Ueki et al. ..... 210/96.1
8,297,213 B2 * 10/2012 Liberg ..... 114/125
2010/0018448 A1 1/2010 Arai et al.

* cited by examiner

*Primary Examiner* — Lars A Olson
*Assistant Examiner* — Jovon Hayes
(74) *Attorney, Agent, or Firm* — Dave A. Ghatt

(57) ABSTRACT

A method and apparatus for reducing mixing between a first water-type and a second water-type and for increasing the efficiency of ballast water exchange procedures on a ship. The apparatus includes a plurality of ballast water tanks, each having an arrangement to reduce water-mixing. Each arrangement includes a horizontal flow restraining box and two anti-mixing brackets. The ballast water tanks are divided into a plurality of compartments including a main compartment. The arrangement to reduce the water-mixing is provided in the main compartment of each tank.

17 Claims, 6 Drawing Sheets

BALLAST STRUCTURE FOR REDUCING WATER-MIXING IN SHIPS

CROSS-REFERENCE TO RELATED APPLICATIONS

This application claims the benefit of U.S. Provisional Application No. 61/385,604, entitled, "Ballast Structure for Reducing Water-Mixing in Ships," filed Sep. 23, 2010, which is incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a method and apparatus for reducing mixing between a first water-type and a second water-type during ballast water exchange procedures on a ship.

BACKGROUND

Great Lakes bulk carrier ships carry cargo, such as iron ore, from the U.S. Great Lakes to ports across the Atlantic Ocean, where the cargo's displacement is replaced by fresh or brackish ballast water for the return trip. Before ballast water management practices were commonplace, this ballast water was subsequently off-loaded in the Great Lakes when the ship took on its next load of cargo. Unfortunately, coastal ballast water contains many species of micro-organisms that are non-indigenous to the Great Lakes and these non-indigenous species destroy local aquatic flora and fauna. To avoid this type of harm to the environment, ballast water exchange procedures, where the coastal water in the ballast tanks is exchanged with relatively harmless mid-ocean surface seawater, have been introduced.

There are two types of ballast water exchange methods, reballasting (empty-refill) and flow-through (flushing). The empty-refill method incurs the possibility of structural damage to the ship because of the discontinuity in structural loading and in addition, may cause unacceptable variations in trim and draft due to single empty tanks, and therefore, is not widely practiced. Flow-through ballast water exchange requires pumping of mid-ocean water into the bottom of a full or partially full ballast tank, allowing the water to exit the top of the tank. Since the tanks remain full at all times, the problems associated with empty-refill are avoided. However, because of mixing between the incoming salt water and the fresh water, proper flushing of the fresh water is only accomplished after the application of multiple tank volumes of sea water. In fact, calculations show that for perfectly mixed fluids, three volume exchanges are necessary to replace 95% of the original fresh water with a 100% replacement never possible. It is desired to have a flow-through ballast water exchange arrangement that more efficiently replaces the fresh water in ballast tanks.

SUMMARY

In one aspect, the invention is a ballast water tank for reducing water-mixing during ballast water exchange procedures. In this aspect, the ballast water tank includes a lower region having an inlet for receiving incoming water, wherein the inlet is directed towards the bottom of the water tank. The ballast water tank also includes an upper region having an outlet for expelling water and an arrangement to reduce water-mixing, the arrangement positioned within the lower region. The arrangement to reduce the water-mixing includes a horizontal flow restraining box surrounding the inlet restricting an inlet flow in a substantially horizontal direction, and two anti-mixing brackets positioned adjacent to the horizontal flow restraining box, so that the horizontal flow restraining box is between the two anti-mixing brackets. The horizontal flow restraining box includes a plurality of exit openings directing the substantially horizontal flow towards the two anti-mixing brackets.

In another aspect, the invention is a ship for reducing water-mixing during ballast water exchange procedures. The ship includes a hull having a bottom portion and an upper deck. The ship further includes a plurality of ballast water tanks arranged throughout the hull, each ballast tank extending from the bottom portion of the hull towards the upper deck of the hull. In this aspect, each ballast tank includes a lower region having an inlet for receiving incoming water, wherein the inlet is directed towards the bottom of the water tank. Each tank further includes an upper region having an outlet that extends to the upper deck of the hull for expelling water at the upper deck, and an arrangement to reduce water-mixing, the arrangement positioned within the lower region. In this aspect, the arrangement includes a horizontal flow restraining box surrounding the inlet restricting an inlet flow in a substantially horizontal direction. The arrangement also includes two anti-mixing brackets positioned adjacent to the horizontal flow restraining box, so that the horizontal flow restraining box is between the two anti-mixing brackets, wherein the horizontal flow restraining box comprises a plurality of exit openings directing the substantially horizontal flow towards the one or more anti-mixing brackets.

In yet another aspect, the invention is a method for reducing mixing between a first water-type and a second water-type during ballast water exchange procedures on a ship. In this aspect, the method includes the providing of a plurality of ballast tanks on the ship. Each ballast tank is provided with a lower region having an inlet, wherein the inlet is directed towards the bottom of the water tank, and an upper region having an outlet. Each tank also includes an arrangement to reduce water-mixing, the arrangement positioned within the lower region. The arrangement includes a horizontal flow restraining box surrounding the inlet, and two anti-mixing brackets positioned adjacent to the horizontal flow restraining box, wherein the horizontal flow restraining box includes a plurality of exit openings directed towards the two anti-mixing brackets. In this aspect, the method further includes introducing the first water-type into the plurality of ballast tanks via the respective inlet. The method further includes, after introducing the first water-type, introducing the second water-type into the plurality of ballast tanks via the respective inlet. The method further includes utilizing the horizontal flow restraining box and the two anti-mixing brackets to restrict the inlet flow of the second water-type in a substantially horizontal direction to reduce the mixing of the first and second water-types. The method also includes the expelling of the first water-type onto an upper deck of the ship via the outlet.

BRIEF DESCRIPTION OF THE DRAWINGS

Other features will be apparent from the description, the drawings, and the claims.

DETAILED DESCRIPTION

Figure 1A:
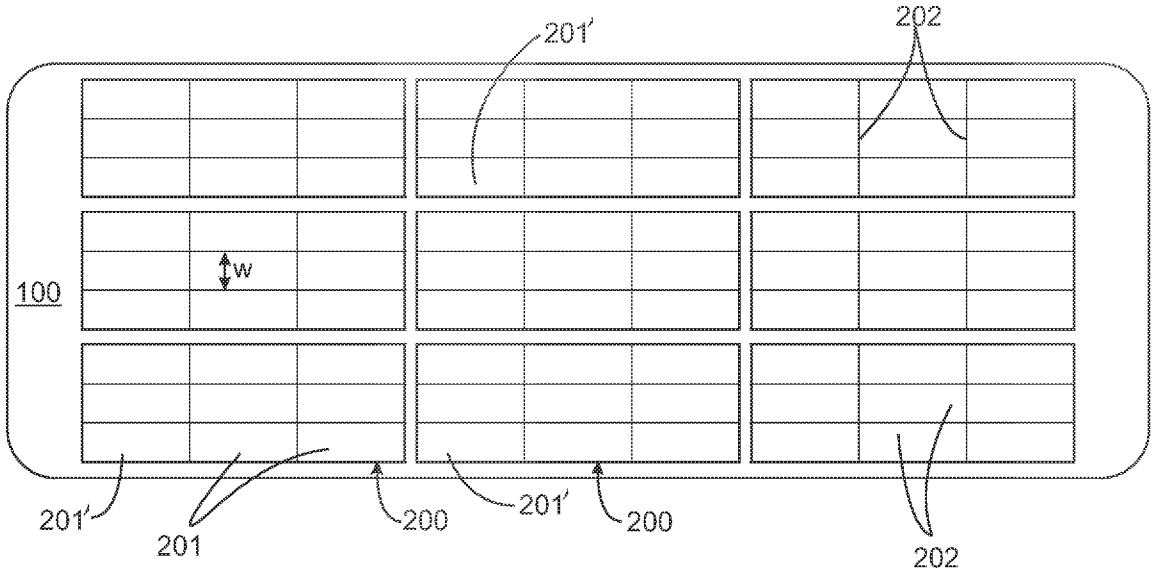
FIG. 1A is a schematic top-sectional view of a ship having a ballast water tank arrangement, according to an embodiment of the invention.
Figure 1B:
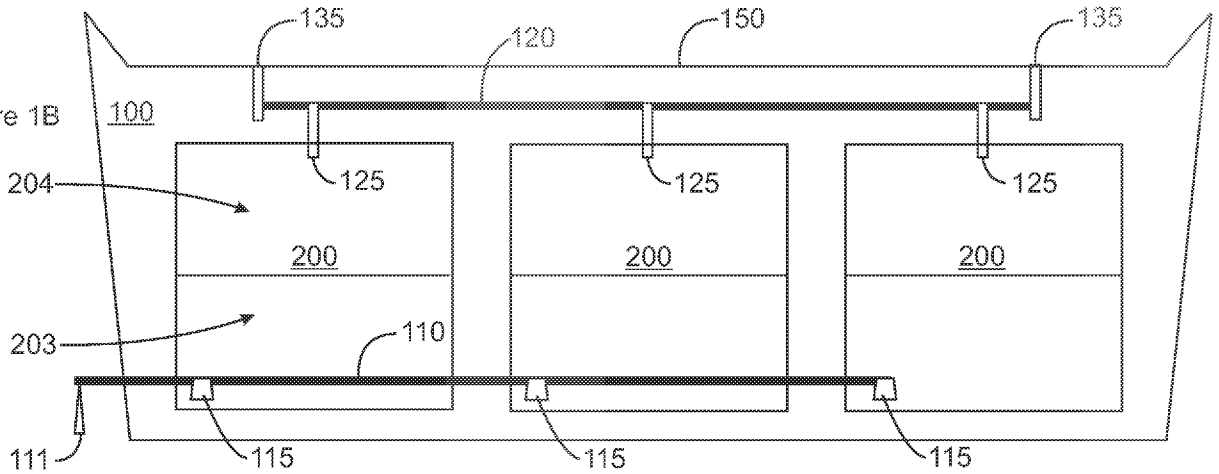
FIG. 1B is a schematic side-sectional view of a ship having a ballast water tank arrangement, according to an embodiment of the invention.

FIG. 1A is a top-sectional schematic view of a ship 100 having a ballast water tank arrangement having a plurality of ballast water tanks 200, according to an embodiment of the invention. FIG. 1B is a side-sectional schematic view of the ship 100, also showing the ballast water tank arrangement having a plurality of ballast water tanks 200. FIG. 1B also shows each tank divided into a lower region 203 towards the bottom of the tank 200, and an upper region 204 towards the top of the tank 200. The figures show the ship 100 including a plurality of ballast tanks 200 arranged throughout the hull of the ship 100. The ship 100 may be a bulk carrying cargo ship or the like, and each tank 200 may have a volume of about 400,000 gallons. Although FIG. 1A shows the ship 100 having 9 tanks 200, the ship may typically have about 8 to about 12 tanks, depending on the type of ship. Ships 100 may also have more than 12 tanks or less than 8 tanks.

FIG. 1A also shows each tank 200 divided into separated compartments 201, separated by compartment walls 202. Although FIG. 1A shows each tank being divided into 9 compartments, a tank 200 may be divided into less than 9 compartments or more than 9 compartments, depending on the application and or the size of the tank 200. FIG. 1A shows each tank 200 having a main compartment 201', which includes an arrangement 210 to reduce mixing between a first water-type and a second water-type, which is outlined below. The compartments (201, 201') together form a complicated structure of each tank 200, with each tank 200 including lightening holes, limber holes, and other slots for drainage. As outlined below, compartment walls 202 may also include a plurality of manholes 280 and base holes 285 for directing the flow of water from one compartment to an adjacent compartment. The manholes 280 may be oval shaped or may be circular, and are positioned at an upper part of the lower region. The base holes 285 are typically smaller than the manholes 280, and are positioned near the bottom of the tank. Manholes may be used for personnel access and may be about 400 mm×600 mm in overall dimension for oblong openings, or may be 500 mm diameter circular openings. The base holes 285 are smaller tank floor openings that are used for drainage and may be limberholes and lightning holes. These holes may be circular and may range in size but, according to an embodiment of the invention may be of the order of about 200 mm in diameter, or smaller.

FIG. 1B schematically shows pipelines 110 and 120, for regulating liquids on and off the ship 100. Although not illustrated, the pipelines 110 and 120 may include one or more pumps for regulating the flow of water to different regions of the ship 100. Pipeline 110 runs from a ship intake 111, through which the ship 100 takes in the surrounding water, through to the lower region 203 of the various tanks 200 and respective compartments (201, 201'). The pipeline 110 branches into a bell mouth inlet 115 in each main compartment 201'. Each bell mouth inlet 115 supplies the water from the intake 111 into each respective tank 200, and as shown, is oriented to point downwards towards the bottom of the tank. The pipeline 110 may be a connected network of pipelines that branch out from a single intake 111. Alternatively, the pipeline may be a plurality of non-connected pipelines, with each individual pipeline supplied by a different intake 111.

FIG. 1B also shows a pipeline 120 that runs from each tank 200 to an upper deck 150 of the ship 100. In each tank, the pipeline includes one or more outlets 125 in the upper region 204, which direct water collected in the top of each tank 200 to a ship exhaust 135, at the upper deck 150. Similar to the pipeline 110, the pipeline 120 may be a connected line, or may be a collection of non-connected lines. It should be noted that the dimensions of compartments may vary depending on the requirements of the system and the size of the ship 100. According to an embodiment of the invention, the ship 100 may be a bulk carrying cargo ship having 10 rows of compartments, including double bottom, hopper side tank, and upper wing tank compartments. The overall dimensions for a single ballast tank may be about 24.0 m long, and about 14.72 m high, and may measure about 5.2 m transversely. The total volume for a single ballast tank as detailed above is about 185,740 gallons.

Figure 2:
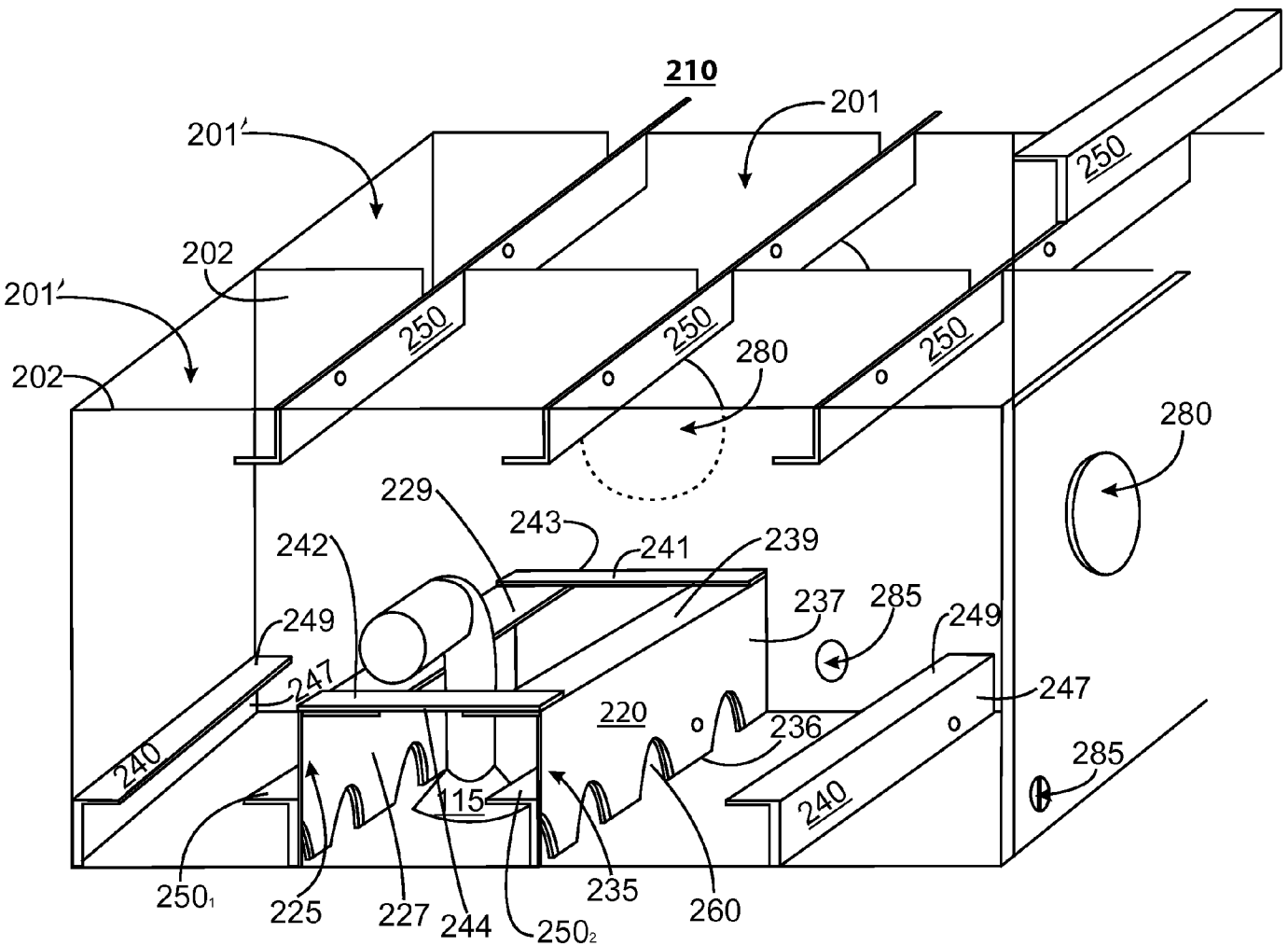
FIG. 2 is a perspective illustration of an arrangement to reduce mixing between a first water-type and a second water-type in a ballast water tank during ballast water exchange procedures, according to an embodiment of the invention.

FIG. 2 is a perspective illustration of an arrangement 210 to reduce mixing between a first water-type and a second water-type in a ballast water tank 200 during ballast water exchange procedures, according to an embodiment of the invention. The arrangement 210 is positioned within the lower region 203 (shown in FIG. 1B) of the tank 200 and within the main compartment 201'. The arrangement 210 includes a horizontal flow restraining box 220 and two anti-mixing brackets 240. As shown, the horizontal flow restraining box 220 surrounds the bell mouth inlet 115, so that mouth of the inlet is substantially in the middle of the box 220. FIG. 2 shows the anti-mixing brackets 240 positioned adjacent to the horizontal flow restraining box 220, so that the horizontal flow restraining box is between the two anti-mixing brackets 240. As shown, the anti-mixing brackets 240 are substantially L-shaped, each having a vertical arm 247 and a horizontal arm 249. FIG. 2 also shows the anti-mixing brackets extending from the first compartment wall 202 at one end to the second oppositely situated compartment wall 202, at the other end. As outlined below, the horizontal arm extends horizontally to restrict the upward flow of water, thereby reducing water-mixing.

The horizontal flow restraining box 220 extends from a first compartment wall 202 to a second opposite compartment wall 202. Thus, the length of the box is equal to the width w of the main compartment 201'. The box 220 includes a first substantially L-shaped bracket 225 having a vertical arm 227 and a substantially perpendicular horizontal arm 229. As shown, the substantially L-shaped bracket 225 extends from the first compartment wall 202 to the second oppositely situated compartment wall 202. The bracket 225 is oriented such that a bottom edge portion 226 of the vertical arm contacts the bottom of the tank. The horizontal flow restraining box 220 also includes a second substantially L-shaped bracket 235, substantially identical to the first bracket 225, also having a vertical arm 237 and a substantially perpendicular horizontal arm 239. The second substantially L-shaped bracket 235 also extends from a first compartment wall 202 to a second oppositely situated compartment wall 202, so that the second bracket 235 is parallel to the first bracket 225. The second bracket 235 is also oriented such that a bottom edge portion 236 of the vertical arm contacts the bottom of the tank. As shown, the first and second brackets 225 and 235 are oriented so that the first is a mirror-like reflection of the second. Thus, from the point of contact with the vertical arms 227 and 237, the horizontal arms 229 and 239, respectively, extend towards each other.

The horizontal flow restraining box 220 also includes a first plate 241 extending from the first substantially L-shaped bracket 225 to the second substantially L-shaped bracket 235. As shown, the first plate 241 is positioned on top of the horizontal arms (229, 239) of each of the first and second L-shaped brackets (225, 235). A longitudinal flat edge 243 of the first plate 241 makes full contact with the first compartment wall 202. The horizontal flow restraining box 220 further includes a second plate 242 also extending from the first substantially L-shaped bracket 225 to the second substantially L-shaped bracket 235. The second plate 242 is also positioned on top of the horizontal arms (229, 239) of each of the first and second L-shaped brackets (225, 235), with a longitudinal flat edge 244 of the second plate 241 making full contact with the second oppositely situated compartment wall 202.

The arrangement of the plates 241 and 242 on top of the horizontal arms 229 and 230 of the brackets 225 and 235 creates a substantially rectangular opening at the top of the horizontal flow restraining box 220. The bell mouth inlet 115 projects through the substantially rectangular opening, down towards the bottom of the tank. The bell mouth opening may be positioned about 1 inch to about 3 inches above the bottom of the tank.

FIG. 2 also shows a plurality of support beams 250 that provide structural support for the tank 200 and compartments (201, 201') therein. The support beams 250 include support beam portions $\mathbf{250}_1$ and $\mathbf{250}_2$ which lay at the bottom of the tank 200 in the main compartment 201', and which also extend from the first compartment wall 202 to the second oppositely situated compartment wall 202. The first and second vertical arms 227 and 237 are erected to be flush against the respective support beam portions $\mathbf{250}_1$ and $\mathbf{250}_2$ as both the beams arms extend the length of the compartment from the first compartment wall 202 to the second compartment wall 202. As shown, the horizontal flow restraining box 220 also includes exit openings 260 extending through bottom portions of both the vertical arms 227 and 237 and the support beams $\mathbf{250}_1$ and $\mathbf{250}_2$. The exit openings 260 may have semi-circular shapes, with the flat portion of the semi-circle being located along the bottom of the ballast water tank.

The flow through ballast water exchange operation of the arrangement is outlined in the explanatory illustrations of FIGS. 3A, 3B, 3C, 4A, 4B, and 4C. As stated above, typically before ballast water exchange operations, the ballast tanks 200 are fully or partially full with a first water-type, which is introduced into the tank via the inlet 115. During the operation, the first water-type is replaced with a second water-type. The first water-type may be coastal, fresh, or brackish water and the second water-type may be seawater from the middle of the ocean.

Figure 3A:
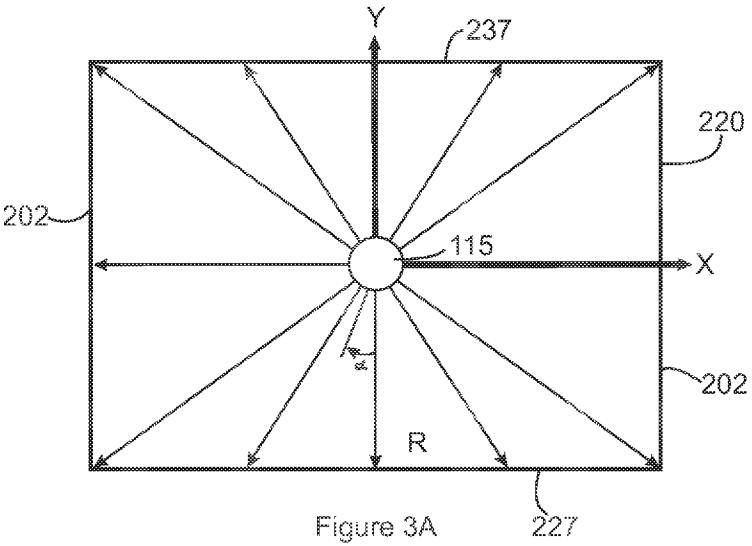
FIG. 3A is an explanatory top view of the flow of water entering the horizontal flow restraining box, according to an embodiment of the invention.

FIG. 3A is an explanatory top view of the movement of the second water-type entering the horizontal flow restraining box 220, according to an embodiment of the invention. FIG. 3A shows the inlet 115, which feeds both the first and the second water-type into the horizontal flow restraining box 220. According to an embodiment of the invention, the flow enters through the bell mouth inlet 115 at a rate of about 1,500 gallons per minute to about 3,000 gallons per minute. During operation, inlet 115 supplies the second water-type into the tank 200 which is fully or partially full with a first water-type. Because of the bell mouth design of the inlet 115 and because of the positioning of the mouth of the inlet in close proximity to the bottom of the tank, i.e., about 1 inch to about 3 inches above the bottom, the flow is substantially horizontal. FIG. 3A shows the flow of the second water-type being in the horizontal plane directed at an angle $\alpha$ to reference line R, where a may be any value from 0 to 360 degrees. Thus, from the inlet 115, the flow may be directed at any of the two compartment walls 202, or the two horizontal arms 227 and 237 of the substantially L-shaped brackets 225 and 235, respectively. For analytical purposes, the flow in all a directions may be separated into perpendicular two vector components Y and X, with the Y being a transverse direction and X being a longitudinal direction.

Figure 3B:
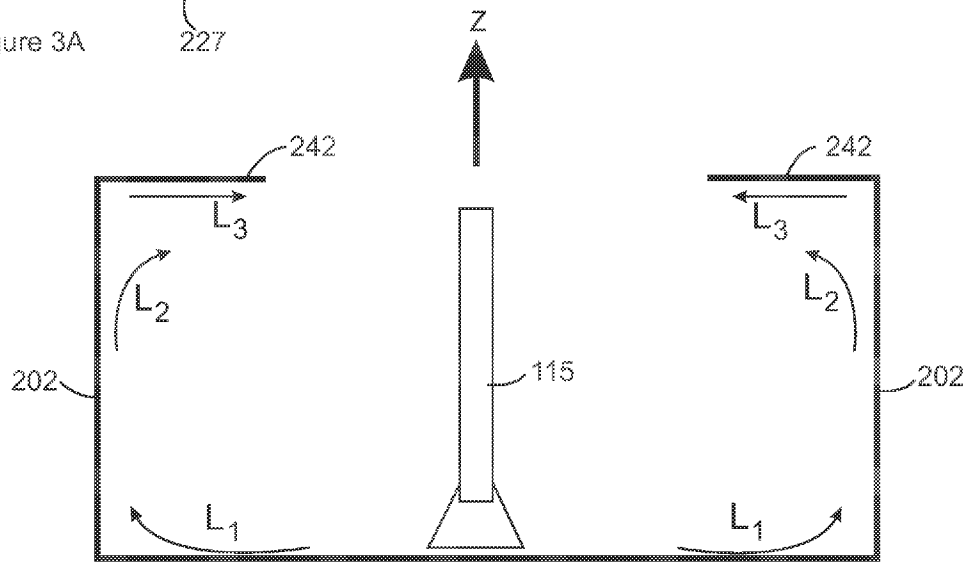
FIG. 3B is an explanatory illustration of the flow of water in the longitudinal direction X within the horizontal flow restraining box, according to an embodiment of the invention.

FIG. 3B is an explanatory illustration of the flow of water in the longitudinal direction X within the horizontal flow restraining box 220. As shown, the longitudinal flow of water $L_1$ from the bell mouth inlet 115, which may be seawater, is directed towards the oppositely located compartment walls 202. Upon contact with the walls 202, some of the energy of the flow is absorbed and dissipated by the walls 202, substantially preventing the vertical Z-direction flow. Although a substantial amount of the flow in the Z-direction is restricted, a reduced energy Z-direction flow, $L_2$, may persist, and this $L_2$ flow is directed up the walls 202, where the $L_2$ flow contacts the plates 241 and 242, the plates further absorbing and dissipating the energy of the flow. The further reduced energy flow $L_3$ may continue, as illustrated, but because of the orientation of the plates 241 and 242, further flow in the vertical direction Z is prevented.

Figure 3C:
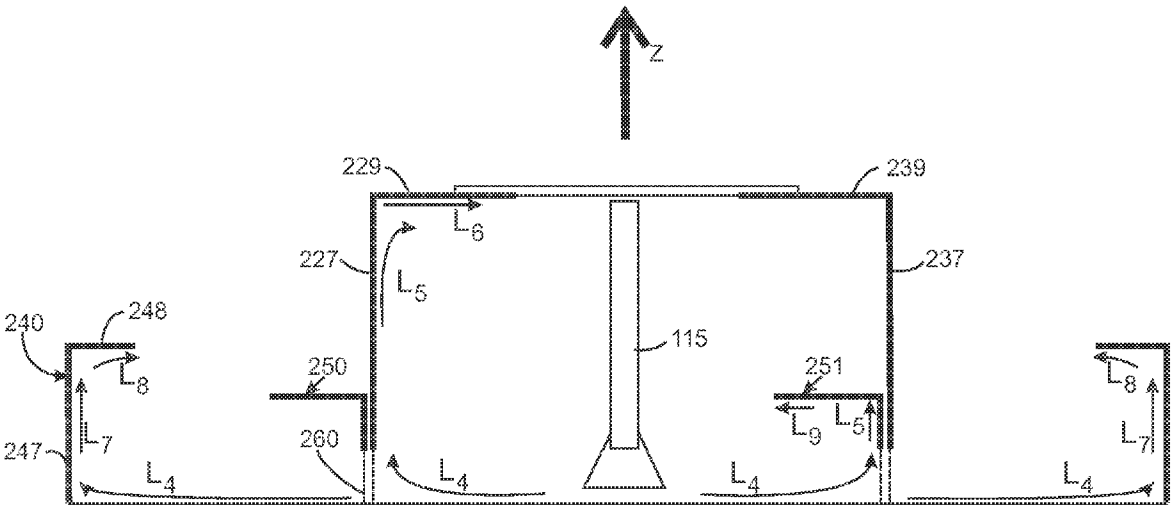
FIG. 3C is an explanatory illustration of the flow of water in the transverse direction Y within the horizontal flow restraining box and at the anti-mixing brackets, according to an embodiment of the invention.

FIG. 3C is an explanatory illustration of the flow of water in the transverse direction Y within the horizontal flow restraining box 220 and at the anti-mixing brackets 240. As shown in FIG. 3C, the transverse flow of water $L_4$ from the bell mouth inlet 115, which may be seawater, is directed towards the oppositely located substantially L-shaped brackets 225 and 235, where the flow $L_4$ may make contact with the respective vertical arm 227 and 237. Alternatively, the flow $L_4$ may flow out through one of the plurality of exit openings 260. When the flow $L_4$ makes contact with the vertical arms 227 and 237, some of the energy of the flow is absorbed and dissipated by the vertical arms, substantially preventing the vertical Z-direction flow. Although a substantial amount of the flow in the Z-direction is restricted, a reduced energy Z-direction flow, $L_5$, may persist, and this $L_5$ flow is directed up the faces of the vertical arms 227 and 237. As shown in FIG. 3C, the $L_5$ flow at the left rises and contacts the horizontal arm 229. The horizontal arm 229 further absorbs and dissipates the energy of the flow. The further reduced energy flow $L_6$ may continue, as illustrated, but because of the orientation of the horizontal arm 229, further flow in the vertical direction Z is prevented. FIG. 3C also shows the $L_5$ flow at the right contacting the horizontal arm 251 of the support beam $\mathbf{250}_2$. Horizontal arm 251 further absorbs and dissipates the energy of the flow. The further reduces flow $L_9$ may continue, but because of the orientation of the horizontal arm 251, further flow in the vertical Z direction is prevented.

Figure 3D:
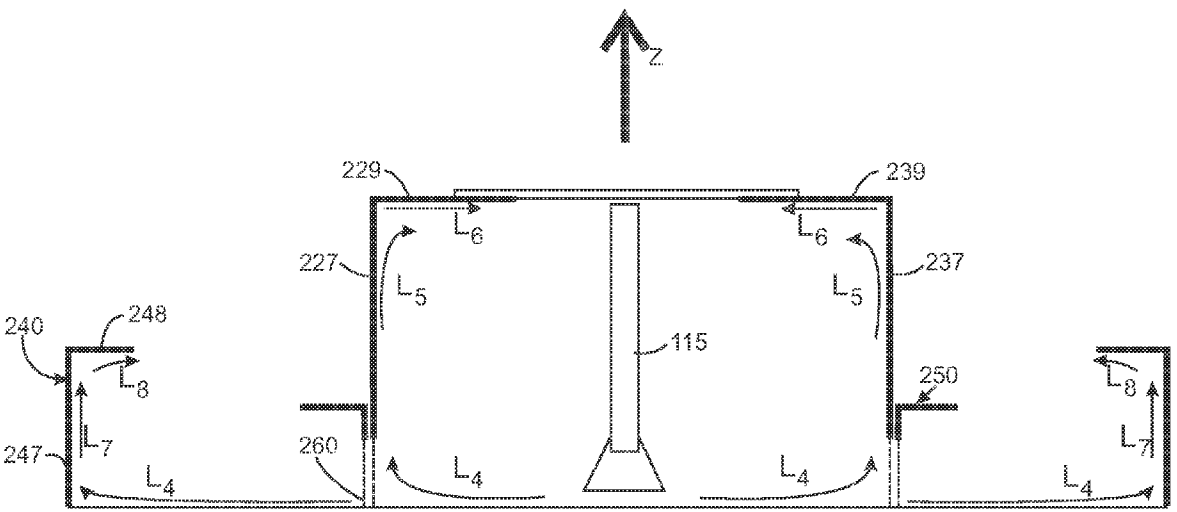
FIG. 3D is an explanatory illustration of the flow of water in the transverse direction Y within the horizontal flow restraining box and at the anti-mixing brackets, according to an embodiment of the invention.

It should be noted that according to an embodiment of the invention, the horizontal flow restraining box may optionally not include the support beam $\mathbf{250}_2$ within the box 220. This embodiment is illustrated in FIG. 3D. According to this embodiment, the vertical flow $L_5$ would then be restrained by the horizontal arm 239. The further reduced energy flow $L_6$ may continue, as illustrated, but because of the orientation of the horizontal arm 239, further flow in the vertical direction Z is prevented.

Returning to FIG. 3C (also shown in FIG. 3D), when the flow $_{L4}$ exits the horizontal flow restraining box 220 via one of the plurality of exit openings 260, the flow is directed towards the anti-mixing brackets 240. Similar to the above described flow regimes, the flow $_{L4}$ then makes contact with the vertical arms 247 of the brackets 240, where some of the energy of the flow is absorbed and dissipated by the vertical arms, substantially preventing the vertical Z-direction flow. Although a substantial amount of the flow in the Z-direction is restricted, a reduced energy Z-direction flow, $_{L7}$, may persist, and this $L_7$ flow is directed up the faces of the vertical arms 247, and into contact with the horizontal arms 249, the horizontal arms further absorbing and dissipating the energy of the flow. The further reduced energy flow $L_8$ may continue, as illustrated, but because of the orientation of the horizontal arms 249, further flow in the vertical direction Z is prevented.

As outlined above, during flow through ballast water exchanges, the second water-type entering via the inlet 115 may typically be seawater, and the first water-type may be coastal, fresh, or brackish water. Because of the arrangement as outlined above with respect to FIGS. 3A-3D, the vertical flow of the incoming seawater is arrested, resulting in the seawater being restrained to the bottom of the compartment 201'. Regarding the inter-compartment flow, with the seawater constrained to the bottom of the compartment 201', there is a natural advection of the seawater through the base holes 285 without the mixing of the first and second water-types. This provides an interface between compartments that is at equilibrium before the flow goes through the manholes 280 above, thereby substantially eliminating mixing at the manholes 280. Throughout the tank 200, a similar flow occurs between connected compartments, via the respective base holes 285.

Figure 4B:
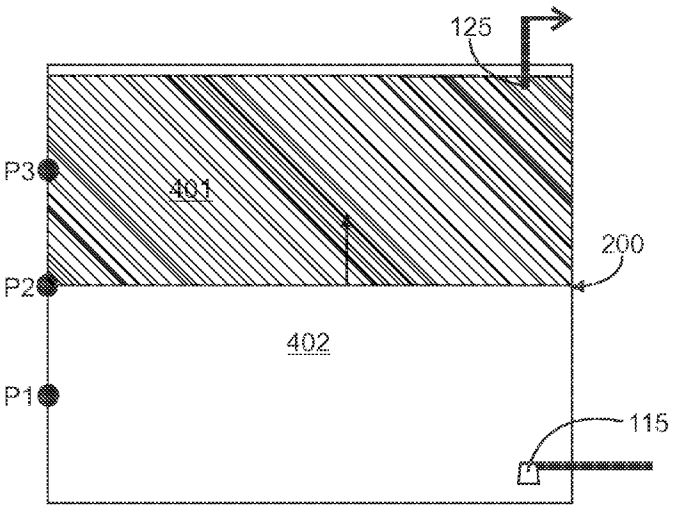
FIGS. 4A-4C are explanatory illustrations showing the progression of the plug flow, according to an embodiment of the invention.
Figure 4A:
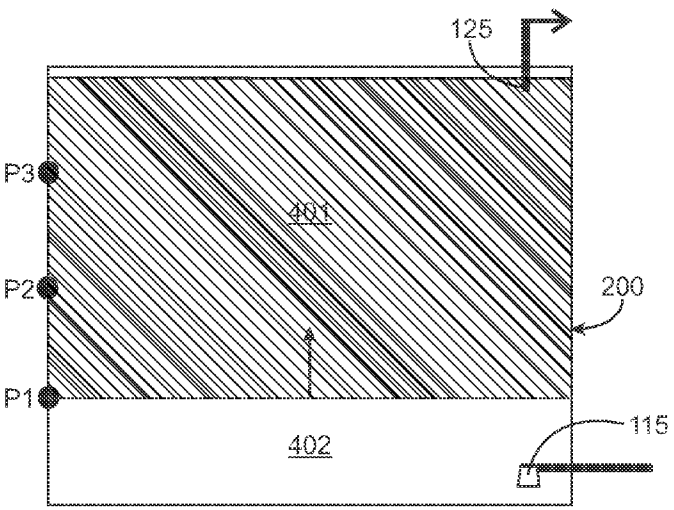
Figure 4C:
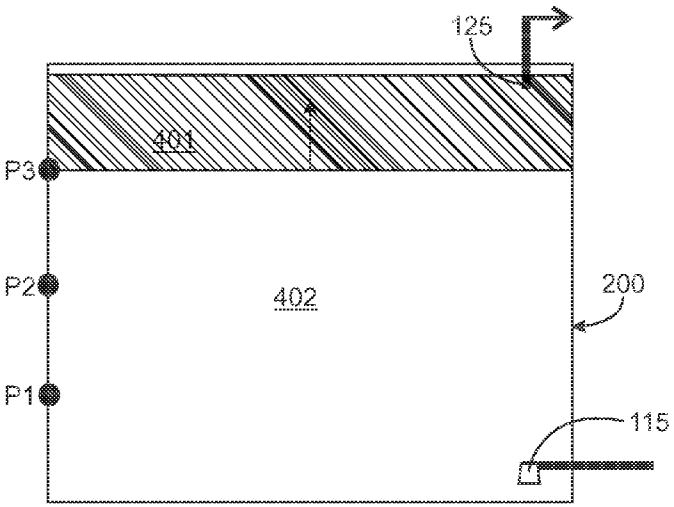

Because the upward flow of the seawater is arrested as outlined above, the only vertical movement of the seawater in the tank 200 is due to the volumetric flow upwards, as the amount of seawater in the compartments 201 and 201' increase. As the level of the seawater rises, the seawater pushes the first water-type up in a piston-like manner, in what is termed a piston or a plug flow. FIGS. 4A-4C are explanatory illustrations showing the progression of the plug flow, according to an embodiment of the invention.

FIGS. 4A-4C each show the tank 200, having a first water-type 401 and a second water-type 402. As outlined above, the first water-type may be coastal, fresh, or brackish water and the second water-type may be seawater, which typically has a high content of salt. FIGS. 4A-4C also shows an interface 400 between the two water-types. FIG. 4A shows the interface at a point $P_1$ when a first volume of seawater has been taken into the tank 200, via inlet 115. FIG. 4B shows the interface at a point $P_2$ above $P_1$, after the volume of seawater has been increased. FIG. 4B also shows the volume of the first water-type 401 being reduced from the amount illustrated in FIG. 4A because as the seawater 402 rises, it pushes the first water-type 401, via the plug flow, out of the tank, via the outlet 125. FIG. 4C shows the interface at a point $P_3$ above $P_2$ after additional seawater has been added. FIG. 4C also shows the volume of the first fluid 401 being further reduced as the seawater pushes the first water-type, via the plug flow, up and out of the tank 200.

As outlined above, in prior art arrangements, because of mixing between the incoming salt water and the fresh water, proper flushing of the fresh water is only accomplished after the application of multiple tank volumes of sea water. Calculations show that for perfectly mixed fluids, three volume exchanges are necessary to replace 95% of the original fresh water with a 100% replacement never possible. Because of the arrangement, as outlined above with respect to FIGS. 3A, 3B, 3C, 4A, 4B, and 4C, in which the water is exchanged via the piston-like plug flow, the efficiency of the exchange after a single volume exchange approaches 100%. Thus, the instant arrangement improves and reduces the time for flow-through exchange by about two-thirds.

Figure 5:
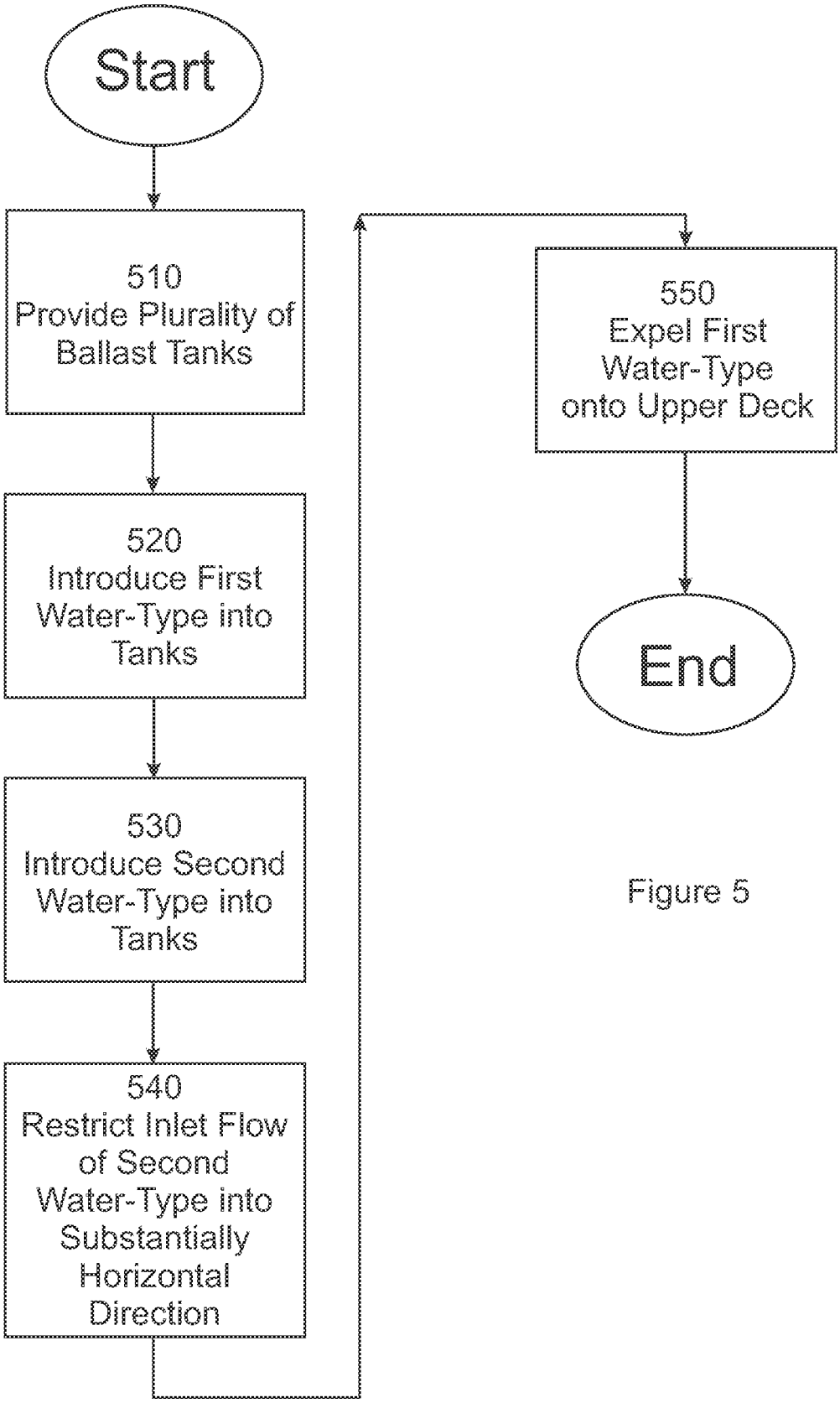
FIG. 5 is a flow chart of a method for reducing mixing between a first water-type and a second water-type during ballast water exchange procedures, according to an embodiment of the invention.

FIG. 5 is a flow chart of a method 500 for reducing mixing between a first water-type 401 and a second water-type 402 during ballast water exchange procedures on a ship 100. The steps involved in the method 500 of reducing the mixing between the first and second water-types have been outlined above in detail in the description with respect to FIGS. 1-4C. The steps outlined below merely outline some of the general steps involved, and are not an all inclusive recitation of the method described above.

Step 510 is the providing of a plurality of ballast tanks 200 on the ship 100. As outlined above, each tank includes a lower region 203 having an inlet 115, wherein the inlet 115 is directed towards the bottom of the water tank. Each tank 200 further includes an upper region 204 having an outlet 125. Each tank further includes an arrangement to reduce water-mixing, with the arrangement positioned within the lower region 203. The arrangement includes a horizontal flow restraining box 220 surrounding the inlet 125, and two anti-mixing brackets 240 positioned adjacent to the horizontal flow restraining box 220. As shown in FIG. 2, the horizontal flow restraining box 220 includes a plurality of exit openings 260 directed towards the two anti-mixing brackets 240.

Step 520 is the introducing the first water-type into the plurality of ballast tanks via the respective inlet 115. The first water-type may be coastal, fresh, or brackish water, and when introduced, may fill or partially fill the tank 200. Step 530 takes place after introducing the first water-type. At step 530 the second water-type 402 is introduced into the plurality of ballast tanks 200 via the respective inlet 115. The second water-type may be seawater.

Step 540 is the utilizing of the horizontal flow restraining box and the two anti-mixing brackets to restrict the inlet flow of the second water-type in a substantially horizontal direction to reduce the mixing of the first and second water-types. As outlined with respect to FIGS. 3A-3C, a first portion ($L_1$, $L_4$) of the inlet flow of the second water-type is restricted in the restraining box, whilst a second portion ($L_4$) of the inlet flow of the second water-type is directed through the exit openings 260 and in restricted by the anti-mixing brackets 240.

Step 550 is the expelling the first water-type onto an upper deck of the ship via the outlet. As outlined above, in the expelling of the first water-type, the upward volumetric flow of the first fluid type pushes the first fluid type in a piston-like manner, out of the outlet in the upper region of the tank. FIGS. 4A-4C illustrate a progression of this expulsion of the first fluid type, according to an embodiment of the invention.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A ballast water tank for reducing water-mixing during ballast water exchange procedures, the ballast water tank comprising:

a lower region having an inlet for receiving incoming water, wherein the inlet is directed towards the bottom of the water tank;

an upper region having an outlet for expelling water;

an arrangement to reduce water-mixing, the arrangement positioned within the lower region of the ballast water tank, comprising:

a horizontal flow restraining box surrounding the inlet restricting an inlet flow in a substantially horizontal direction, wherein said horizontal flow restraining box comprises:

a first substantially L-shaped bracket having a vertical arm and a substantially perpendicular horizontal arm; and a second substantially L-shaped bracket having a vertical arm and a substantially perpendicular horizontal arm, wherein the horizontal arms of each of the first and second substantially L-shaped brackets extend towards each other; and two anti-mixing brackets positioned adjacent to the horizontal flow restraining box, so that the horizontal flow restraining box is between the two anti-mixing brackets, wherein each of the first and second substantially L-shaped brackets of the horizontal flow restraining box comprises a plurality of exit openings directing the substantially horizontal flow towards the two anti-mixing brackets.

2. The ballast water tank of claim 1, wherein the tank further comprises a plurality compartments including a main compartment, each compartment separated by compartment walls, wherein said arrangement to reduce water-mixing is located in said main compartment, and wherein said horizontal flow restraining box extends from a first compartment wall of said main compartment to a second oppositely located compartment wall of said main compartment.

3. The ballast water tank of claim 2, wherein the first substantially L-shaped bracket extends from the first compartment wall to the second compartment wall, the bracket oriented such that a bottom edge portion of the vertical arm contacts the bottom of the tank, and wherein the second substantially L-shaped bracket extends from the first compartment wall to the second compartment wall, the bracket oriented such that a bottom edge portion of the vertical arm contacts the bottom of the tank, said horizontal flow restraining box further comprises:

a first plate extending from the first substantially L-shaped bracket to the second substantially L-shaped bracket, wherein the first plate is positioned on top of the horizontal arms of each of the first and second L-shaped brackets;

a second plate extending from the first substantially L-shaped bracket to the second substantially L-shaped bracket, wherein the second plate is positioned on top of the horizontal arms of each of the first and second L-shaped brackets, thereby forming an substantially rectangular opening between the first plate, the second plate, the first horizontal arm, and the second horizontal arm, wherein the inlet extends into the horizontal flow restraining box to the bottom of the tank, via the substantially rectangular opening.

4. The ballast water tank of claim 3, wherein the arrangement to reduce water-mixing further comprises:

a first support beam extending from the first compartment wall of the main compartment to the second oppositely located compartment wall of the main compartment, wherein the first support beam contacting the first vertical arm of the substantially L-shaped bracket;

a second support beam extending from the first compartment wall to the second oppositely located compartment wall, wherein the second support beam contacts the second vertical arm of the substantially L-shaped bracket;

wherein the plurality of exit openings are formed in the first and second vertical arms of the substantially L-shaped brackets and further extends through the first and second support beams respectively, wherein each of said plurality of exit openings has a substantially semi-circular shape, with the flat portion of each semi-circle being located along the bottom of the ballast water tank.

5. The ballast water tank of claim 4, wherein the one or more anti-mixing brackets comprise a substantially L-shaped bracket having a vertical arm and a horizontal arm, the horizontal arm extending horizontally to restrict the upward flow of water, thereby reducing water-mixing.

6. The ballast water tank of claim 5, wherein each compartment wall between adjacent compartments include a manhole opening to allow for the flow of water between adjacent compartments.

7. A ship for reducing water-mixing during ballast water exchange procedures, the ship comprising:

a hull having a bottom portion and an upper deck;

a plurality of ballast water tanks arranged throughout the hull, each ballast tank extending from the bottom portion of the hull towards the upper deck of the hull, wherein each ballast tank comprises:

a lower region having an inlet for receiving incoming water, wherein the inlet is directed towards the bottom of the water tank;

an upper region having an outlet that extends to the upper deck of the hull for expelling water at the upper deck;

an arrangement to reduce water-mixing, the arrangement positioned within the lower region of the respective ballast tank, comprising:

a horizontal flow restraining box surrounding the inlet restricting an inlet flow in a substantially horizontal direction, wherein said horizontal flow restraining box comprises:

a first substantially L-shaped bracket having a vertical arm and a substantially perpendicular horizontal arm; and a second substantially L-shaped bracket having a vertical arm and a substantially perpendicular horizontal arm, wherein the horizontal arms of each of the first and second substantially L-shaped brackets extend towards each other; and two anti-mixing brackets positioned adjacent to the horizontal flow restraining box, so that the horizontal flow restraining box is between the two anti-mixing brackets, wherein each of the first and second substantially L-shaped brackets of the horizontal flow restraining box comprises a plurality of exit openings directing the substantially horizontal flow towards the one or more anti-mixing brackets.

8. The ship of claim 7, wherein each ballast tank further comprises a plurality compartments including a main compartment, each compartment separated by compartment walls, wherein said arrangement to reduce water-mixing is located in said main compartment, and wherein said horizontal flow restraining box extends from a first compartment wall of said main compartment to a second oppositely located compartment wall of said main compartment.

9. The ship of claim 8, wherein the first substantially L-shaped bracket extends from the first compartment wall to the second compartment wall, the bracket oriented such that a bottom edge portion of the vertical arm contacts the bottom of the tank, and wherein the second substantially L-shaped bracket extends from the first compartment wall to the second compartment wall, the bracket oriented such that a bottom edge portion of the vertical arm contacts the bottom of the tank, said horizontal flow restraining box of each ballast tank further comprises:

a first plate extending from the first substantially L-shaped bracket to the second substantially L-shaped bracket, wherein the first plate is positioned on top of the horizontal arms of each of the first and second L-shaped brackets;

a second plate extending from the first substantially L-shaped bracket to the second substantially L-shaped bracket, wherein the second plate is positioned on top of the horizontal arms of each of the first and second L-shaped brackets, thereby forming an substantially rectangular opening between the first plate, the second plate, the first horizontal arm, and the second horizontal arm, wherein the inlet extends into the horizontal flow restraining box to the bottom of the tank, via the substantially rectangular opening.

10. The ship of claim 9, wherein each arrangement to reduce water-mixing further comprises:

a first support beam extending from the first compartment wall of the main compartment to the second oppositely located compartment wall of the main compartment, wherein the first support beam contacting the first vertical arm of the substantially L-shaped bracket;

a second support beam extending from the first compartment wall to the second oppositely located compartment wall, wherein the second support beam contacts the second vertical arm of the substantially L-shaped bracket;

wherein the plurality of exit openings are formed in the first and second vertical arms of the substantially L-shaped brackets and further extends through the first and second support beams respectively, wherein each of said plurality of exit openings has a substantially semi-circular shape, with the flat portion of each semi-circle being located along the bottom of the ballast water tank.

11. The ship of claim 10, wherein the one or more anti-mixing brackets in each ballast tank comprise a substantially L-shaped bracket having a vertical arm and a horizontal arm, the horizontal arm extending horizontally to restrict the upward flow of water, thereby reducing water-mixing.

12. The ship of claim 11, wherein each compartment wall between adjacent compartments include a manhole opening to allow for the flow of water between adjacent compartments of each ballast tank.

13. A method for reducing mixing between a first water-type and a second water-type to increase the efficiency of ballast water exchange procedures on a ship, the method comprising;

providing a plurality of ballast tanks on the ship wherein each ballast tank comprising;

a lower region having an inlet, wherein the inlet is directed towards the bottom of the water tank;

an upper region having an outlet;

an arrangement to reduce water-mixing, the arrangement positioned within the lower region the respective ballast tank, comprising:

a horizontal flow restraining box surrounding the inlet restricting an inlet flow in a substantially horizontal direction wherein said horizontal flow restraining box comprises:

a first substantially L-shaped bracket having a vertical arm and a substantially perpendicular horizontal arm; and a second substantially L-shaped bracket having a vertical arm and a substantially perpendicular horizontal arm, wherein the horizontal arms of each of the first and second substantially L-shaped brackets extend towards each other; and two anti-mixing brackets positioned adjacent to the horizontal flow restraining box, wherein each of the first and second substantially L-shaped brackets of the horizontal flow restraining box comprises a plurality of exit openings directed towards the two anti-mixing brackets;

wherein each ballast tank further comprises a plurality compartments including a main compartment, each compartment separated by compartment walls, wherein said arrangement to reduce water-mixing is located in said main compartment, and wherein said horizontal flow restraining box extends from a first compartment wall of said main compartment to a second oppositely located compartment wall of said main compartment, and wherein the first substantially L-shaped bracket extends from the first compartment wall to the second compartment wall, the bracket oriented such that a bottom edge portion of the vertical arm contacts the bottom of the tank, and wherein the second substantially L-shaped bracket extends from the first compartment wall to the second compartment wall, the bracket oriented such that a bottom edge portion of the vertical arm contacts the bottom of the tank;

the method further comprising:

introducing the first water-type into the plurality of ballast tanks via the respective inlet;

after introducing the first water-type, introducing the second water-type into the plurality of ballast tanks via the respective inlet;

utilizing the horizontal flow restraining box and the two anti-mixing brackets to restrict the inlet flow of the second water-type in a substantially horizontal direction to reduce the mixing of the first and second water-types; and expelling the first water-type onto an upper deck of the ship via the outlet.

14. The method of claim 13, wherein the utilizing of the horizontal flow restraining box and the two anti-mixing brackets to restrict the inlet flow includes;

restricting the upward flow of a first portion of the inlet flow of the second water-type within the horizontal flow restraining box;

directing a second portion of the inlet flow of the second water-type through the plurality of exit openings towards the one or more anti-mixing brackets; and restricting the upward flow of the second portion of the inlet flow of the second water-type utilizing the geometry of the two anti-mixing brackets.

15. The method of claim 14, wherein in the expelling of the first fluid type, the upward volumetric flow of the first fluid type pushes the first fluid type in a piston-like manner, out of the outlet in the upper region of the tank.

16. The method of claim 15, wherein in the providing of the plurality of ballast tanks, the horizontal flow restraining box of each ballast tank further comprises:

a first plate extending from the first substantially L-shaped bracket to the second substantially L-shaped bracket, wherein the first plate is positioned on top of the horizontal arms of each of the first and second L-shaped brackets;

a second plate extending from the first substantially L-shaped bracket to the second substantially L-shaped bracket, wherein the second plate is positioned on top of the horizontal arms of each of the first and second L-shaped brackets, thereby forming an substantially rectangular opening between the first plate, the second plate, the first horizontal arm, and the second horizontal arm, wherein the inlet extends into the horizontal flow restraining box to the bottom of the tank, via the substantially rectangular opening.

17. The method of claim 16, wherein in the providing of the plurality of ballast tanks, each arrangement to reduce water-mixing further comprises:

a first support beam extending from the first compartment wall of the main compartment to the second oppositely located compartment wall of the main compartment, wherein the first support beam contacting the first vertical arm of the substantially L-shaped bracket;

a second support beam extending from the first compartment wall to the second oppositely located compartment wall, wherein the second support beam contacts the second vertical arm of the substantially L-shaped bracket;

wherein the plurality of exit openings are formed in the first and second vertical arms of the substantially L-shaped brackets and further extends through the first and second support beams respectively, wherein each of said plurality of exit openings has a substantially semi-circular shape, with the flat portion of each semi-circle being located along the bottom of the ballast water tank, and wherein the one or more anti-mixing brackets in each ballast tank comprise a substantially L-shaped bracket having a vertical arm and a horizontal arm, the horizontal arm extending horizontally to restrict the upward flow of water, thereby reducing turbulent mixing of the first and second water-types.

* * * * *